US006342862B1

(12) United States Patent
Schoenthal

(10) Patent No.: US 6,342,862 B1
(45) Date of Patent: Jan. 29, 2002

(54) UHF INDOOR TV ANTENNA

(76) Inventor: Philip A. Schoenthal, 326 River Meadow Dr., Rochester, NY (US) 14623

( * ) Notice: Subject to any disclaimer, the term of this patent is extended or adjusted under 35 U.S.C. 154(b) by 0 days.

(21) Appl. No.: 09/636,605

(22) Filed: Aug. 11, 2000

(51) Int. Cl.[7] ..... H01Q 11/12
(52) U.S. Cl. ..... 343/741; 343/866
(58) Field of Search ..... 343/702, 741, 343/742, 866, 867, 895

(56) References Cited

U.S. PATENT DOCUMENTS 1,642,522 A * 9/1927 Vroom
2,501,430 A * 3/1950 Alford ..... 250/33
2,537,191 A 1/1951 Moore
3,051,952 A 8/1962 Pifer
D206,484 S 12/1966 Middlemark
3,653,051 A * 3/1972 Wu ..... 343/702
4,342,999 A * 8/1982 Woodward et al. ..... 343/702
4,785,303 A * 11/1988 Clark et al. ..... 343/742
4,851,857 A 7/1989 Dienes
4,864,632 A 9/1989 Moryama et al.
5,371,509 A * 12/1994 Wallace, Jr. et al. ..... 343/741
5,552,796 A 9/1996 Diamond
5,790,082 A 8/1998 Podger
5,847,683 A * 12/1998 Wolfe et al. ..... 343/866

* cited by examiner

*Primary Examiner*—Don Wong
*Assistant Examiner*—Shih-Chao Chen

(57) ABSTRACT

A UHF indoor TV antenna for providing better UHF TV reception. The UHF indoor TV antenna includes a base member being adapted to rest upon a surface; and also includes a signal receiving member having end portions which is securely disposed in the base member with the signal receiving member extending outwardly from the base member; and further includes a TV connecting member having a first end and a second end which is disposed in the base member and which is connected to the end portions of the signal receiving member.

14 Claims, 2 Drawing Sheets

UHF INDOOR TV ANTENNA

BACKGROUND OF THE INVENTION

1. Field of the Invention

The present invention relates to a delta loop indoor TV antenna and more particularly pertains to a new UHF indoor TV antenna for providing better UHF TV reception.

2. Description of the Prior Art

The use of a delta loop indoor TV antenna is known in the prior art. More specifically, a delta loop indoor TV antenna heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,790,082; 5,552,796; 3,051,952; 4,851,857; 4,864,632; and 2,537,191.

While these devices fulfill their respective, particular objectives and requirements, the aforementioned patents do not disclose a new UHF indoor TV antenna. The inventive device includes a base member being adapted to rest upon a surface; and also includes a signal receiving member having end portions which is securely disposed in the base member with the signal receiving member extending outwardly from the base member; and further includes a TV connecting member having a first end and a second end which is disposed in the base member and which is connected to the end portions of the signal receiving member.

In these respects, the UHF indoor TV antenna according to the present invention substantially departs from the conventional concepts and designs of the prior art, and in so doing provides an apparatus primarily developed for the purpose of providing better UHF TV reception.

SUMMARY OF THE INVENTION

In view of the foregoing disadvantages inherent in the known types of delta loop indoor TV antenna now present in the prior art, the present invention provides a new UHF indoor TV antenna construction wherein the same can be utilized for providing better UHF TV reception.

The general purpose of the present invention, which will be described subsequently in greater detail, is to provide a new UHF indoor TV antenna which has many of the advantages of the delta loop indoor TV antenna mentioned heretofore and many novel features that result in a new UHF indoor TV antenna which is not anticipated, rendered obvious, suggested, or even implied by any of the prior art delta loop indoor TV antenna, either alone or in any combination thereof.

To attain this, the present invention generally comprises a base member being adapted to rest upon a surface; and also includes a signal receiving member having end portions which is securely disposed in the base member with the signal receiving member extending outwardly from the base member; and further includes a TV connecting member having a first end and a second end which is disposed in the base member and which is connected to the end portions of the signal receiving member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new UHF indoor TV antenna which has many of the advantages of the delta loop indoor TV antenna mentioned heretofore and many novel features that result in a new UHF indoor TV antenna which is not anticipated, rendered obvious, suggested, or even implied by any of the prior art delta loop indoor TV antenna, either alone or in any combination thereof.

It is another object of the present invention to provide a new UHF indoor TV antenna which may be easily and efficiently manufactured and marketed.

It is a further object of the present invention to provide a new UHF indoor TV antenna which is of a durable and reliable construction.

An even further object of the present invention is to provide a new UHF indoor TV antenna which is susceptible of a low cost of manufacture with regard to both materials and labor, and which accordingly is then susceptible of low prices of sale to the consuming public, thereby making such UHF indoor TV antenna economically available to the buying public.

Still yet another object of the present invention is to provide a new UHF indoor TV antenna which provides in the apparatuses and methods of the prior art some of the advantages thereof, while simultaneously overcoming some of the disadvantages normally associated therewith.

Still another object of the present invention is to provide a new UHF indoor TV antenna for providing better UHF TV reception.

Yet another object of the present invention is to provide a new UHF indoor TV antenna which includes a base member being adapted to rest upon a surface; and also includes a signal receiving member having end portions which is securely disposed in the base member with the signal receiving member extending outwardly from the base member; and further includes a TV connecting member having a first end and a second end which is disposed in the base member and which is connected to the end portions of the signal receiving member.

Still yet another object of the present invention is to provide a new UHF indoor TV antenna that has a bi-directional signal receiving pattern.

Even still another object of the present invention is to provide a new UHF indoor TV antenna that avoids having to use an impedance matching transformer and its associated 6 db signal losses.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
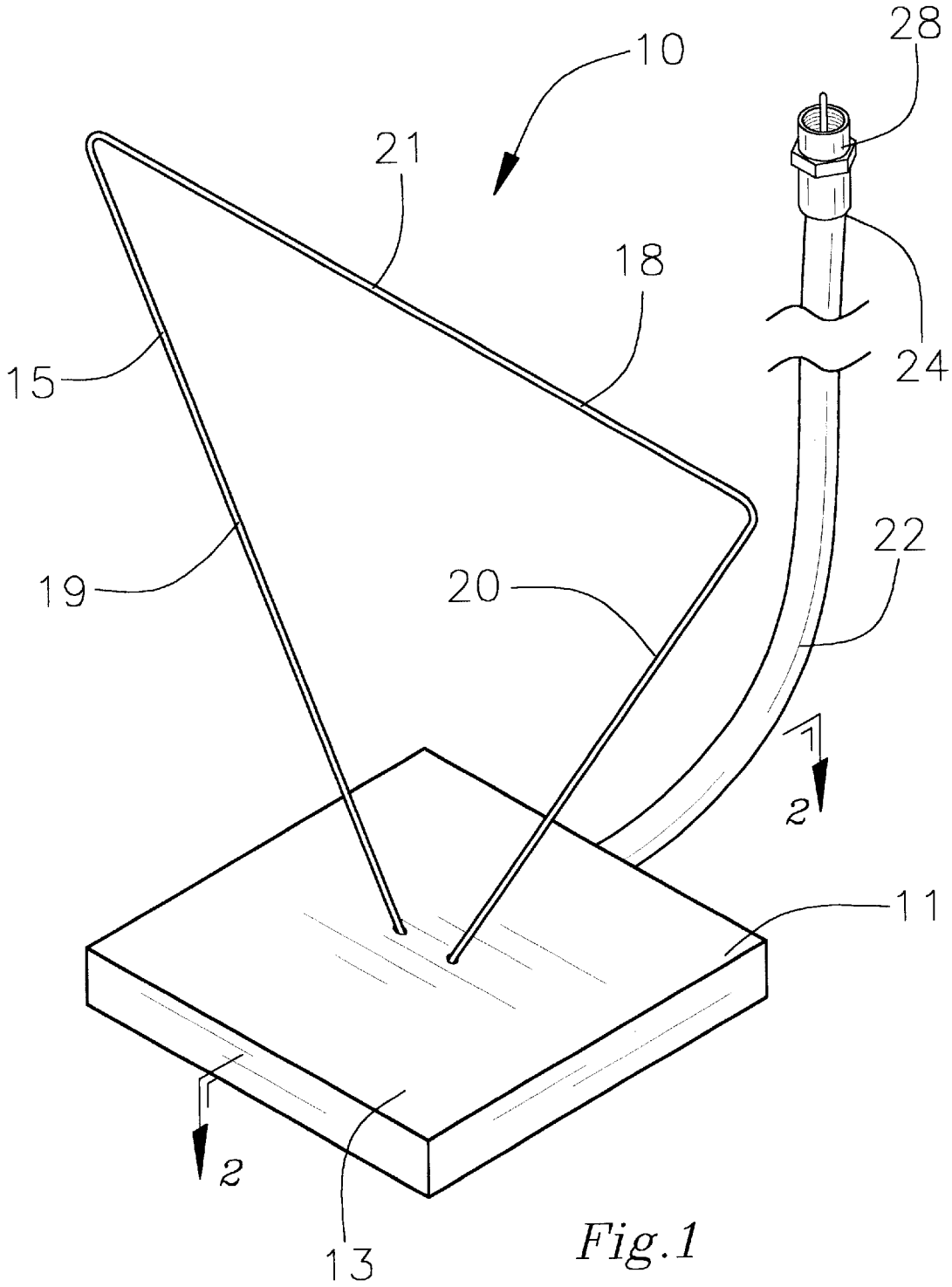
FIG. 1 is a perspective view of a new UHF indoor TV antenna according to the present invention.
Figures 2, 3, 4:
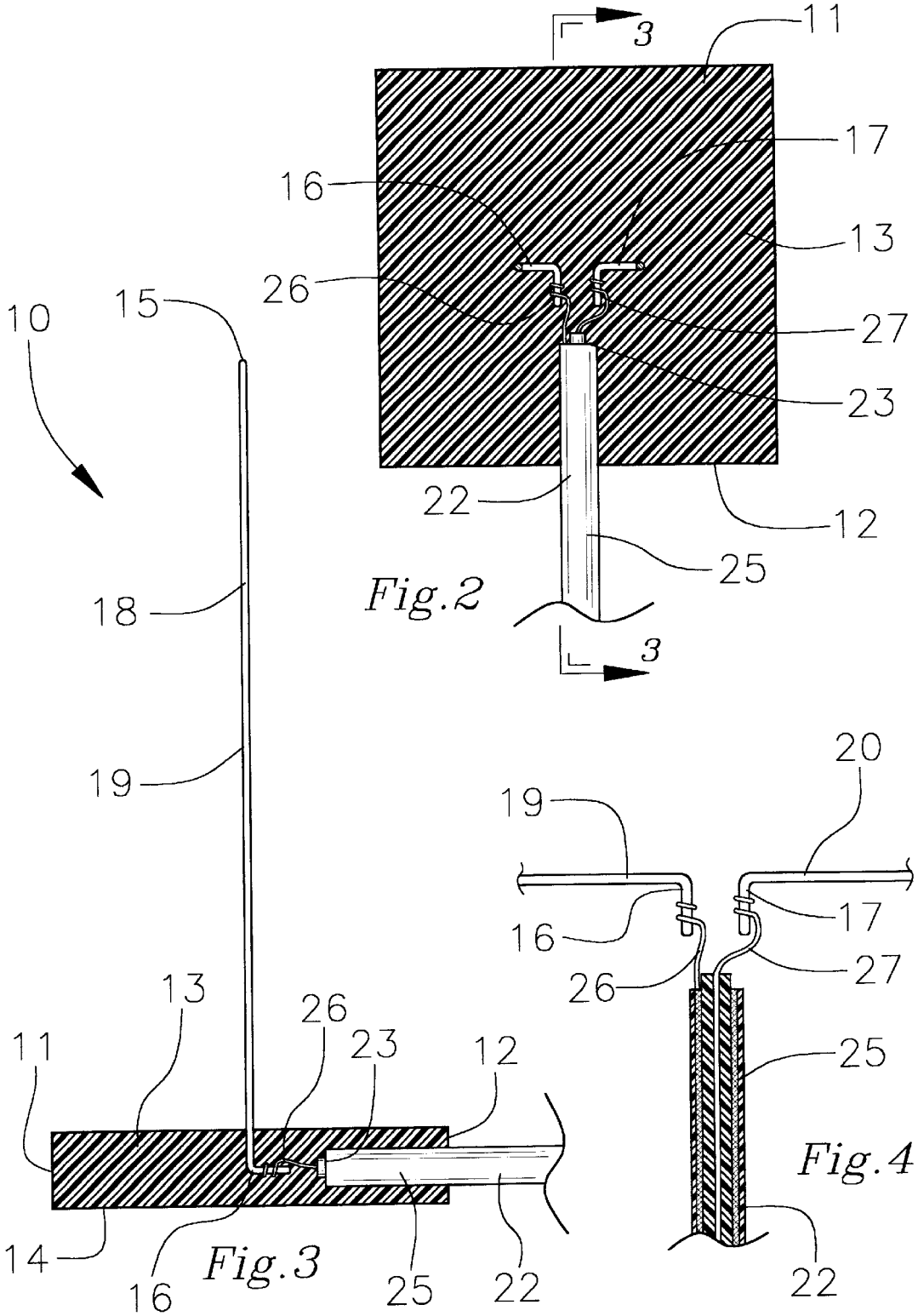
FIG. 2 is a top cross-sectional view of the present invention.
FIG. 3 is a side cross-sectional view of the present invention.
FIG. 4 is a detailed top plan view of the end portions of the signal receiving member and the lead wires of the coaxial cable of the present invention.

With reference now to the drawings, and in particular to FIGS. 1 through 4 thereof, a new UHF indoor TV antenna embodying the principles and concepts of the present invention and generally designated by the reference numeral 10 will be described.

As best illustrated in FIGS. 1 through 4, the UHF indoor TV antenna 10 generally comprises a base member 11 being adapted to rest upon a surface with the base member 11 being essentially made of plastic and having a flat top surface 13 and a flat bottom side 14 and with the base member 11 being approximately 10 centimeters square and having a thickness of approximately one centimeter. The UHF indoor TV antenna 10 also includes a signal receiving member 15 having end portions 16,17 which is securely and conventionally disposed in the base member 11. The signal receiving member 15 extends outwardly from the top surface 13 of the base member 11 with the signal receiving member 15 being essentially formed into a loop having a main portion 18 which is angled relative to the end portions 16,17. The main portion 18 of the signal receiving member 15 has a first end segment 19, an intermediate segment 21 which is angled relative to the first end segment 19, and a second end segment 20 which is angled relative to the intermediate segment 21. The end portions 16,17 extend from the first and second end segments 19,20 with the first and second end segments 19,20 being angled relative to one another and to the base member 11. The first and second end segments 19,20 extend outwardly from the base member 11 and are disposed within a plane and are angled at approximately 56 degrees from one another. The intermediate segment 21 is spaced above and parallel to the base member 11 and is angled approximately 62 degrees from the first and second end segments 19,20 with the main portion 15 of the signal receiving member 15 being essentially an inverted triangular shape. The UHF indoor TV antenna 10 also includes a TV connecting member 22 having a first end 24 and a second end 23 which is securely disposed in the base member 11 through a side 12 thereof and which is connected to the end portions 16,17 of the signal receiving member 15. The TV connecting member 22 includes a coaxial cable 25 having a pair of lead wires 26,27 extending from the second end 23 thereof and also includes a connector member 28 securely and conventionally disposed at the first end 24 of the coaxial cable 25. Each of the lead wires 26,27 is securely attached to a respective end portion 16,17 of the signal receiving member 15. Each of the lead wires 26,27 is spacedly wound about and soldered to a respective end portion 16,17 of the signal receiving member 15.

In use, the user hooks the connector member 28 to the adapter on a TV set and places the base member 11 upon the top of the TV to essentially receive UHF reception.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A UHF indoor TV antenna comprising:

a base member being adapted to rest upon a surface;

a signal receiving member having end portions which is securely disposed in said base member, said signal receiving member extending outwardly from said base member, said signal receiving member forming a loop, said main portion having a linear first end segment, a linear intermediate segment, and a linear second end segment, said linear end segments being oriented at an angle relative to said linear intermediate segment, said end portions extending from said first and second end segments; and a TV connecting member having a first end and a second end which is disposed in said base member and which is connected to said end portions of said signal receiving member.

2. The UHF indoor TV antenna as described in claim 1, wherein said main portion is angled relative to said end portions.

3. The UHF indoor TV antenna as described in claim 1, wherein said TV connecting member includes a coaxial cable having a pair of lead wires extending from said second end thereof and also includes a connector member securely disposed at said first end of said coaxial cable.

4. The UHF indoor TV antenna as described in claim 3, wherein each of said lead wires is securely attached to a respective said end portion of said signal receiving member.

5. The UHF indoor TV antenna as described in claim 4, wherein each of said lead wires is wound about and soldered to a respective said end portion of said signal receiving member.

6. The UHF indoor TV antenna as described in claim 1, wherein said first and second linear end segments extend outwardly from said base member and are disposed within a plane and are angled at approximately 56 degrees from one another.

7. The UHF indoor TV antenna as described in claim 1, wherein said intermediate segment is spaced above and oriented substantially parallel to said base member and is angled approximately 62 degrees from said first and second end segments.

8. The UHF indoor TV antenna as described in claim 1, wherein said main portion of said signal receiving member forms a generally inverted triangular shape.

9. The UHF indoor TV antenna as described in claim 1, wherein said base member is essentially made of plastic and has a flat top surface and a flat bottom side.

10. A UHF indoor TV antenna comprising:

a base member being adapted to rest upon a surface;

a signal receiving member having end portions which is securely disposed in said base member, said signal receiving member extending outwardly from said base member; and a TV connecting member having a first end and a second end which is disposed in said base member and which is connected to said end portions of said signal receiving member;

wherein said signal receiving member is essentially formed into a loop having a main portion which is angled relative to said end portions;

wherein said main portion of said signal receiving member has a first end segment, an intermediate segment which is angled relative to said first end segment, and a second end segment which is angled relative to said intermediate segment, said end portions extending from said first and second end segments;

wherein said first and second end segments are angled relative to one another and to said base member;

wherein said TV connecting member includes a coaxial cable having a pair of lead wires extending from said second end thereof and also includes a connector member securely disposed at said first end of said coaxial cable;

wherein each of said lead wires is securely attached to a respective said end portion of said signal receiving member;

wherein each of said lead wires is wound about and soldered to a respective said end portion of said signal receiving member;

wherein said first and second end segments extend outwardly from said base member and are disposed within a plane and are angled at approximately 56 degrees from one another.

11. The UHF indoor TV antenna as described in claim 10, wherein said intermediate segment is spaced above and parallel to said base member and is angled approximately 62 degrees from said first and second end segments.

12. The UHF indoor TV antenna as described in claim 10, wherein said main portion of said signal receiving member is essentially an inverted triangular shape.

13. The UHF indoor TV antenna as described in claim 10, wherein said base member is essentially made of plastic and has a flat top surface and a flat bottom side.

14. A UHF indoor TV antenna comprising:

a base member being adapted to rest upon a surface, said base member being essentially made of plastic and having a flat top surface and a flat bottom side, said base member being approximately 10 centimeters square and having a thickness of approximately one centimeter;

a signal receiving member having end portions which is securely disposed in said base member, said signal receiving member extending outwardly from said base member, said signal receiving member being essentially formed into a loop having a main portion which is angled relative to said end portions, said main portion of said signal receiving member having a first end segment, an intermediate segment which is angled relative to said first end segment, and a second end segment which is angled relative to said intermediate segment, said end portions extending from said first and second end segments, said first and second end segments being angled relative to one another and to said base member, said first and second end segments extending outwardly from said base member and being disposed within a plane and being angled at approximately 56 degrees from one another, said intermediate segment being spaced above and parallel to said base member and being angled approximately 62 degrees from said first and second end segments, said main portion of said signal receiving member being essentially an inverted triangular shape; and a TV connecting member having a first end and a second end which is disposed in said base member and which is connected to said end portions of said signal receiving member, said TV connecting member including a coaxial cable having a pair of lead wires extending from said second end thereof and also including a connector member securely disposed at said first end of said coaxial cable, each of said lead wires being securely attached to a respective said end portion of said signal receiving member, each of said lead wires being spacedly wound about and soldered to a respective said end portion of said signal receiving member.

* * * * *